US008419566B2

(12) United States Patent
Gill

(10) Patent No.: US 8,419,566 B2
(45) **Date of Patent: *Apr. 16, 2013**

(54) HANDLE WITH CHANGEABLE GRIP

(75) Inventor: David Keith Gill, Pinehurst, NC (US)

(73) Assignee: Eaton Corporation, Cleveland, OH (US)

( * ) Notice: Subject to any disclaimer, the term of this patent is extended or adjusted under 35 U.S.C. 154(b) by 17 days.

This patent is subject to a terminal disclaimer.

(21) Appl. No.: 12/795,772

(22) Filed: Jun. 8, 2010

(65) Prior Publication Data

US 2011/0300966 A1 Dec. 8, 2011

(51) Int. Cl.
*A63B 53/14* (2006.01)

(52) U.S. Cl.
USPC ..... 473/299; 473/300; 473/316

(58) Field of Classification Search ..... 473/300–303, 473/294–299, 549–552, 568, 316–323; 280/821; 74/551.9; 81/489–492; 16/DIG. 12, DIG. 18, 16/DIG. 19, DIG. 24
See application file for complete search history.

(56) References Cited

U.S. PATENT DOCUMENTS

| | | | | | |
|---|---|---|---|---|---|
| 1,626,967 | A | | 5/1927 | Reach | |
| 2,023,131 | A | * | 12/1935 | Gibson | 473/318 |
| 2,103,889 | A | * | 12/1937 | Brisick | 473/303 |
| 2,871,899 | A | * | 2/1959 | Coyle et al. | 81/177.1 |
| 2,941,806 | A | * | 6/1960 | Stevens | 473/298 |
| 3,360,264 | A | * | 12/1967 | Lamkin et al. | 473/298 |
| 4,365,807 | A | | 12/1982 | Melby | |
| 4,461,479 | A | * | 7/1984 | Mitchell | 473/292 |
| 5,374,064 | A | * | 12/1994 | Barber | 473/204 |
| 5,575,724 | A | * | 11/1996 | Hannon et al. | 473/315 |
| 5,653,643 | A | * | 8/1997 | Falone et al. | 473/300 |
| 5,713,104 | A | | 2/1998 | Giampaolo | |
| 5,730,662 | A | * | 3/1998 | Rens | 473/300 |
| 5,749,798 | A | * | 5/1998 | Kuebler et al. | 473/549 |
| 5,769,414 | A | * | 6/1998 | Feche et al. | 473/300 |
| 5,855,525 | A | * | 1/1999 | Turner | 473/300 |
| 5,906,548 | A | | 5/1999 | Hadge | |
| 5,944,617 | A | * | 8/1999 | Falone et al. | 473/300 |
| 6,511,386 | B1 | | 1/2003 | Cacicedo | |
| 7,172,514 | B2 | | 2/2007 | Benson | |
| 7,261,641 | B2 | * | 8/2007 | Lindner | 473/297 |
| 7,435,186 | B1 | | 10/2008 | Miller | |
| 7,458,902 | B2 | * | 12/2008 | Gill | 473/299 |

(Continued)

FOREIGN PATENT DOCUMENTS

| | | |
|---|---|---|
| EP | 1927439 | 6/2008 |
| GB | 2260499 | 4/1993 |
| WO | WO2008/110888 | 9/2008 |

OTHER PUBLICATIONS

European Search Report dated Sep. 26, 2011.
European Patent Office Search Report dated Aug. 19, 2010.

*Primary Examiner* — Stephen L. Blau
(74) *Attorney, Agent, or Firm* — Daniel S. Kalka

(57) ABSTRACT

A handle 14 with a changeable grip 12 for a shock imparting implement has a gripping sleeve 18 positioned on an end 24 of a handle 14 abutting a ledge 28 integrally formed in the handle 14. A threaded cap 20 compresses the gripping sleeve 18 against the ledge 28 to secure the grip 12 to the handle 14. Optional splines 40 on an outer surface of the handle 14 meshing with channels 42 in the gripping sleeve 18 function to prevent slippage or rotation during use.

13 Claims, 5 Drawing Sheets

U.S. PATENT DOCUMENTS

| | | | | |
|---|---|---|---|---|
| 7,479,069 | B2 * | 1/2009 | Cheng et al. | 473/318 |
| 7,634,839 | B2 * | 12/2009 | Blauer et al. | 16/431 |
| 7,877,843 | B2 * | 2/2011 | Holland-Letz | 16/436 |
| 7,992,258 | B1 * | 8/2011 | Stitser | 16/430 |
| 8,216,085 | B2 * | 7/2012 | Fujimoto | 473/292 |
| 2002/0107088 | A1 | 8/2002 | Lamkin | |
| 2006/0094525 | A1 | 5/2006 | Hung | |
| 2006/0287124 | A1 | 12/2006 | Han et al. | |
| 2007/0074374 | A1 | 4/2007 | Chen | |
| 2008/0313859 | A1 | 12/2008 | Chen | |
| 2009/0124408 | A1 | 5/2009 | Schroeder | |
| 2009/0253530 | A1 | 10/2009 | Sugimae | |
| 2010/0248858 | A1 | 9/2010 | Lu | |
| 2011/0053704 | A1 * | 3/2011 | Huang | 473/300 |

* cited by examiner

HANDLE WITH CHANGEABLE GRIP

FIELD

The present disclosure relates in general to a handle with a changeable grip particularly suited for shock imparting implements, and more particularly to a new and improved golf club shaft with a changeable grip.

BACKGROUND

There are many forms of grips available on the market today for a wide variety of implements. These implements can range from hammer handles or other hand tools to sports implements like tennis, squash, or racquetball rackets, or golf clubs. While the present disclosure is particularly suited for a golf club shaft with a changeable grip and described with particular reference thereto, it should be immediately apparent that the present disclosure is not intended to be limited only to golf and extends to any sports grip or hand grip for a shock imparting implement.

Originally, golf club grips consisted primarily of a leather wrap around a handle. Later, molded rubber slip-on grips became available and are still in wide use today. A recent variation on the molded rubber grip is the concept of using a rubber sleeve or underlisting on the handle with a leather or synthetic leather wrap spirally wrapped around the underlisting, or alternatively a single panel cover over the underlisting. Grips are made today from a wide variety in construction and combinations of materials.

As the market demands a wider range of grips with different colors, weights, and sizes, producing a cost effective grip that meets a wide range of customer requirements is becoming very difficult. There still exists a need for an improved changeable grip that imparts or receives shock or force to or from a shock imparting implement. A changeable grip provides greater flexibility in selecting a specific grip for a given application or for use under a wide variety of conditions. It allows the user to select exactly the type of grip needed under the given conditions for the desired application. It is also desirable for the grip to be constructed in a manner that provides a firm grasp with little or no slippage and with good resistance to torque as well as exhibiting good shock absorbing qualities.

A changeable grip further allows for a wide variety of enhancing features to the grip such as designing the grip weight for swing weight control, or even still multiple types of gripping surfaces with interchangeable gripping sleeves of combinations of various materials. Swing weight control, handle stiffness, flex control, shock absorption are just some of the important factors in improving the impact from the implement. The concept of tailoring a grip to provide the user with multiple options minimizes the need for multiple grips and multiple implements.

Thus, it is desirable to have a changeable grip that allows the user to select the right fit and feel for the handle or shaft of a shock imparting implement or tool to meet the needs of the user in a given application.

BRIEF SUMMARY OF THE DISCLOSURE

The present disclosure describes a handle with a changeable grip for a shock imparting implement that offers a wide variety of features.

The handle with the changeable grip according to the present disclosure includes an elongated tubular member having an initial diameter with two ends. A first end is constructed for attachment to a working head. The second end terminates in a butt end with a threaded indentation. The second end further includes a bell shaped section spaced from the butt end towards the first end. The bell shaped section has a diameter larger in size than the initial diameter which then reduces in size to form a ledge. The lower end of a gripping sleeve is slidably received on the second end of the elongated tubular member where it abuts the ledge. A cap with a threaded fastener meshes with the threaded indentation in the butt end of the handle to compress the gripping sleeve up against the ledge.

The handle with changeable grip is particularly suited for use as a golf club shaft with a changeable golf club grip. The design of the present disclosure accommodates the U.S. Golf Association ("USGA") rules requirement for the shaft to extend the full length of the shaft as well as provides a structure that has a simple configuration with reduced parts.

The various features of novelty which characterize the present disclosure are pointed out with particularity in the claims annexed to and forming a part of this disclosure. For a better understanding of the present disclosure and its operating advantages attained with its use, reference is made to the accompanying drawings, and descriptive matter.

DETAILED DESCRIPTION OF THE DISCLOSURE

Figure 1:
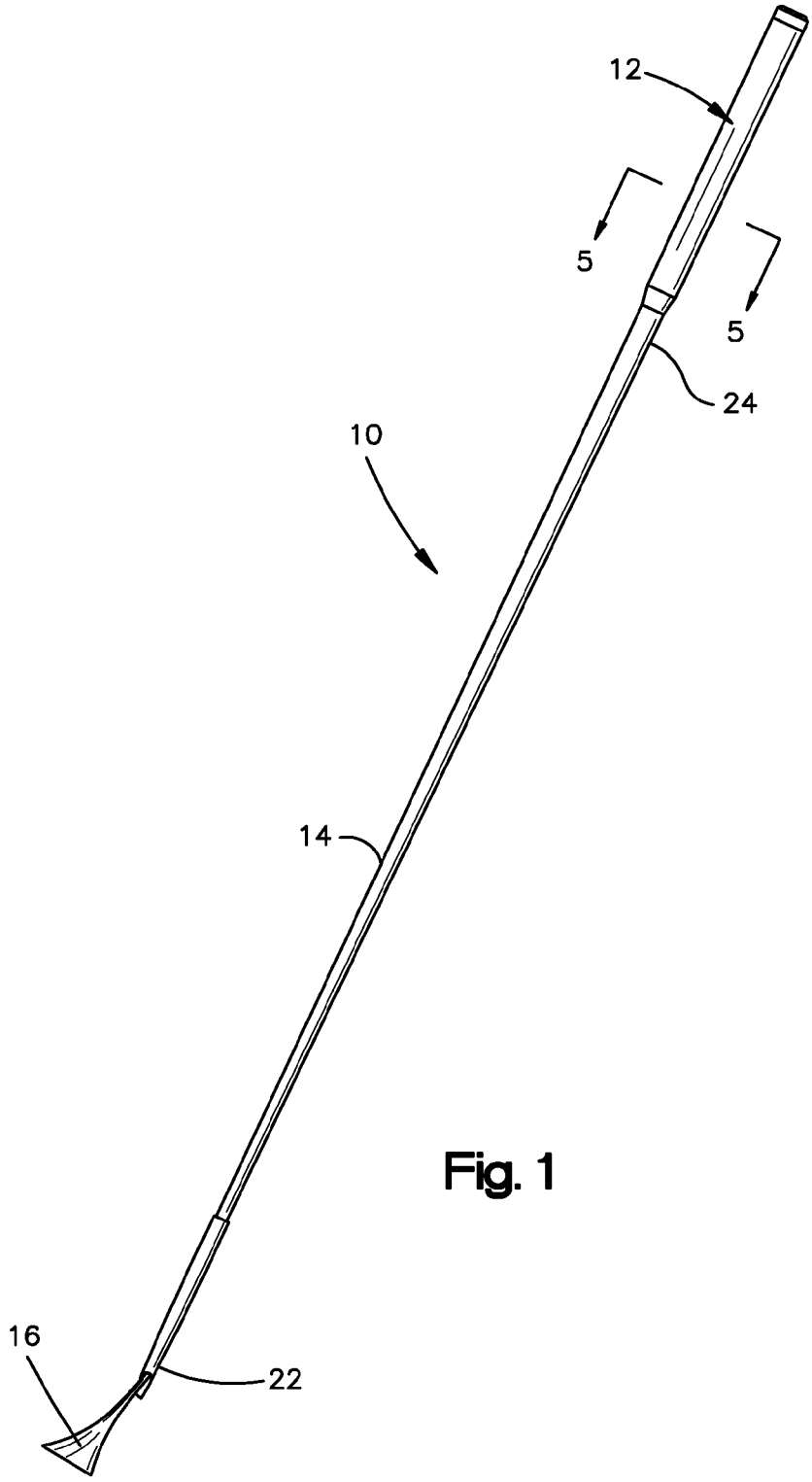
FIG. 1 is an elevated perspective view of a golf club.

Referring to the figures, which are not intended to limit the present disclosure, and where like numerals designate like or similar features throughout the several views, and first in particular to FIG. 1, there is shown a golf club generally designated 10. Golf club 10 includes a golf club grip 12, a shaft or handle 14, and a club head 16. A golf club is but one example of a shock imparting implement that the handle and changeable grip of the present disclosure finds utility. There are many other examples of shock imparting implements known in the art. The term "shock imparting implement" as used herein is meant to include sporting implements and tools that are used to strike, impact, or apply a force to an object or an implement, or conversely receive an impact or force from the implement. Tennis racquets, squash racquets, racquetball racquets, lacrosse grips, fishing rod handles, bicycle handles, motorcycle handles, gear shift levers, and baseball grips are but only a few examples meant to be included in the term "shock imparting implements".

Naturally there are many others, and even possibly more sport items that may still be developed. While particular reference is being made to a golf club handle with a changeable grip in the subject disclosure, it should be understood that the subject disclosure is applicable to any shock imparting implement including but not limited to other sporting implements and tool handles such as a hammer handle or a screwdriver handle.

Figure 2:
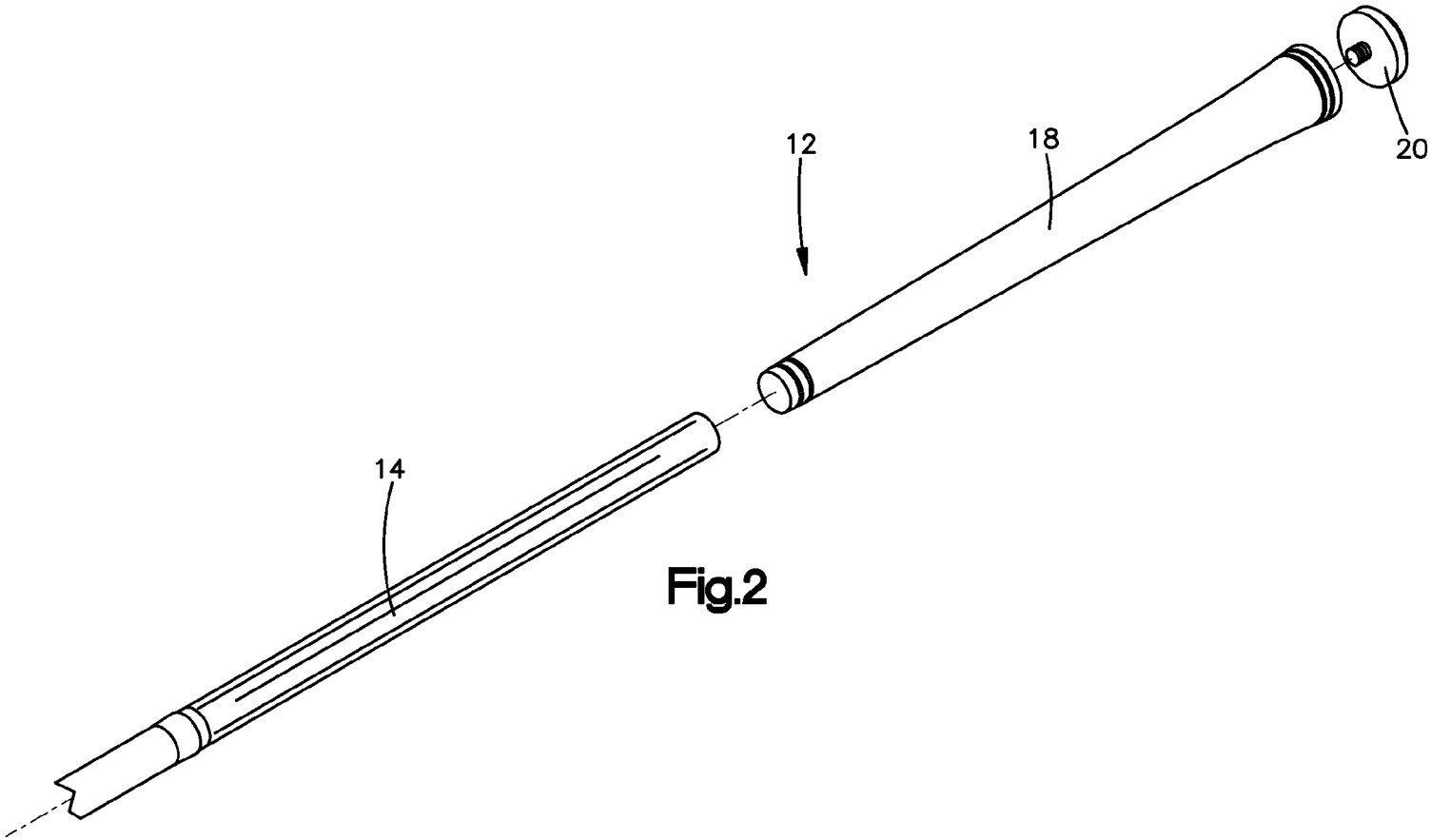
FIG. 2 is an exploded view of a portion of the golf club shaft and changeable grip according to the present disclosure

Referring to FIG. 2, there is shown in exploded view a portion of the shaft 14 and changeable grip 12 according to the present disclosure. The changeable grip 12 basically comprises two parts or elements: a gripping sleeve 18, and a cap 20 which will be described in greater detail later herein.

Figure 3:
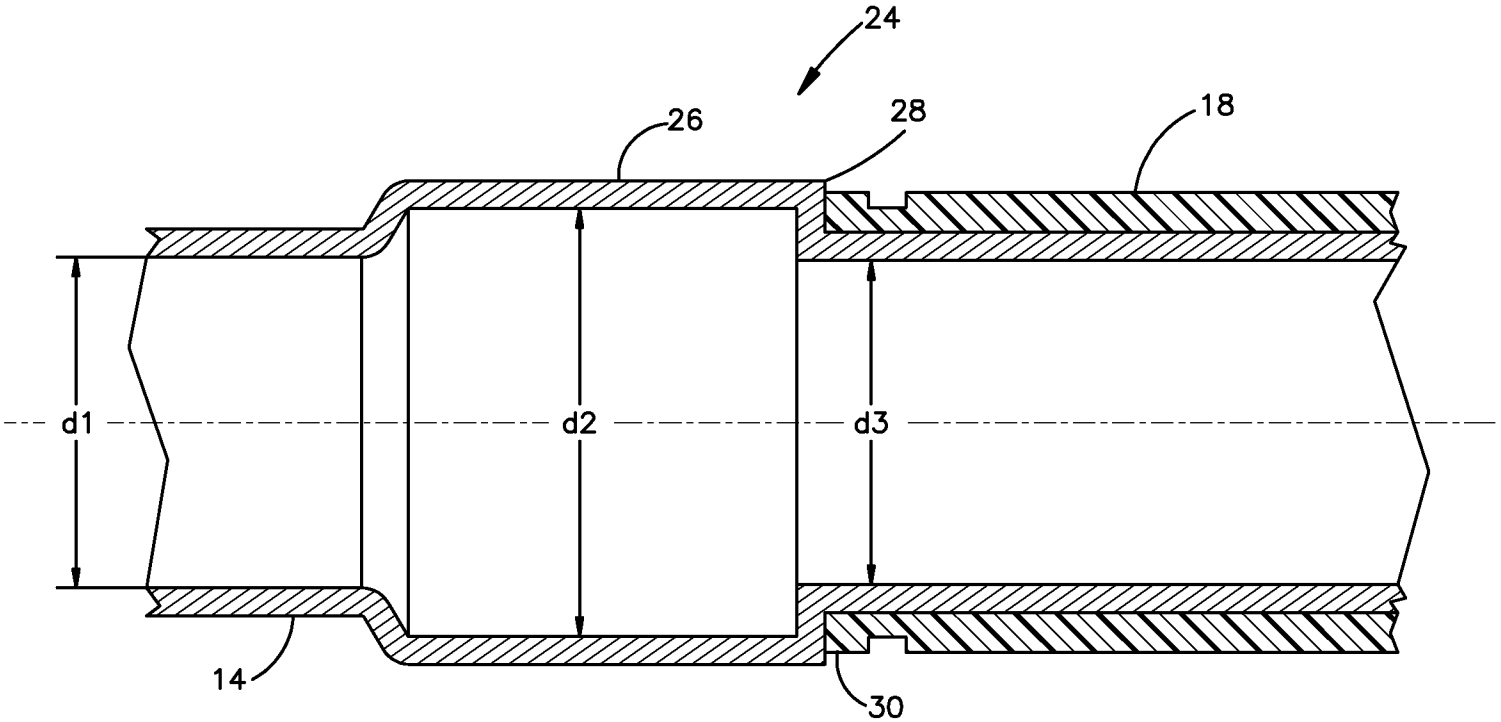
FIG. 3 is an enlarged sectional view of a portion of the golf club shaft and portion of the changeable golf grip according to an embodiment of the present disclosure.

Turning now to FIG. 3, shaft 14 in one embodiment is an elongated tubular member made with an initial diameter (d1). The term "tubular" as used herein is meant to not only include a cylindrical shape or form, but also oval and other fairly cylindrically-shaped forms like polygons. The elongated tubular member 14 has a first and a second end 22, 24. A working head, like the club head 16, may be attached to the first end 22. The second end 24 of the handle 14 receives the gripping sleeve 18. In the present disclosure, the second end 24 of the handle 14 includes a bell shaped section 26 having a diameter (d2) larger than the initial diameter (d1) of shaft 14. Bell shaped section 26 provides a ledge 28 integrally formed in handle 14. In one embodiment, ledge 28 is formed in the shaft 14 by a sharp reduction in the diameter of the bell shaped section 26 to a diameter (d3) which may be equal in size to that of the initial diameter (d1), but does not have to be equal in size. When the gripping sleeve 18 is slid on to handle 14, the lower end 30 abuts the ledge 28 to hold the lower end 30 of the gripping sleeve 18 in place. The bell shaped section 26 and ledge 28 are spaced at a distance from a butt end 32 of the handle 14 to fairly match the desired length of the gripping sleeve 18.

Figure 4:
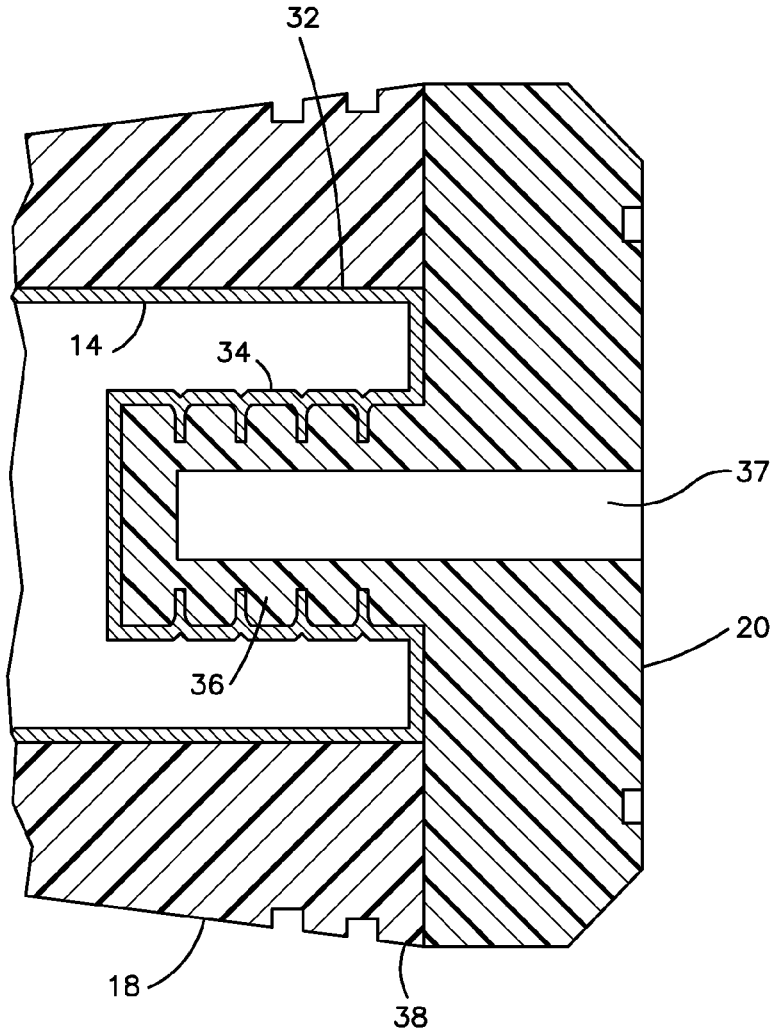
FIG. 4 is an enlarged sectional view of the butt end of the shaft and changeable grip according to an embodiment of the present disclosure.

Next referring to FIG. 4, the butt end 32 of handle 14 has a threaded indentation 34 which may be a threaded aperture or simply an indentation with threads constructed to receive and mesh with a threaded fastener 36. Threaded fastener 36 may be an integral part of cap 20. Alternatively, fastener 36 may be separate from cap 20 simply passing through an opening 37 in cap 20 for securing the cap 20 to the handle 14. As cap 20 is tightened on to the handle 14 through fastener 36, the cap 20 can engage an upper end 38 of the gripping sleeve 18 to compress the gripping sleeve 18 against the ledge 28.

Figure 5:
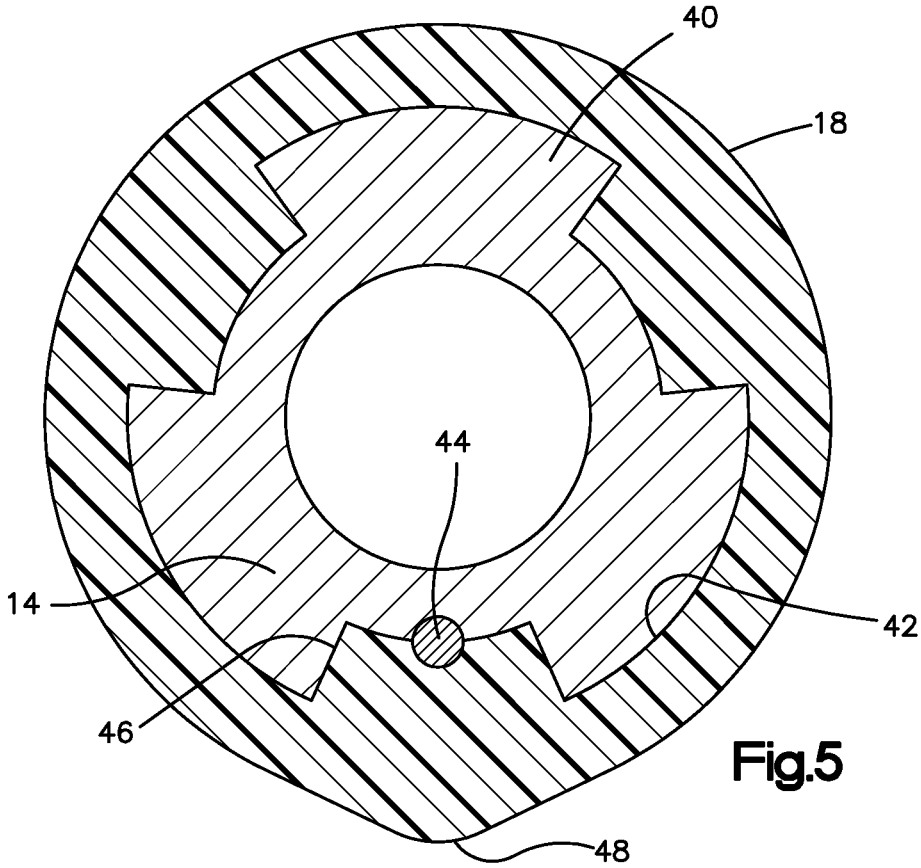
FIG. 5 is a sectional view of the shaft and changeable grip taken at lines 5-5 in FIG. 1 according to an embodiment of the present disclosure.
Figure 6:
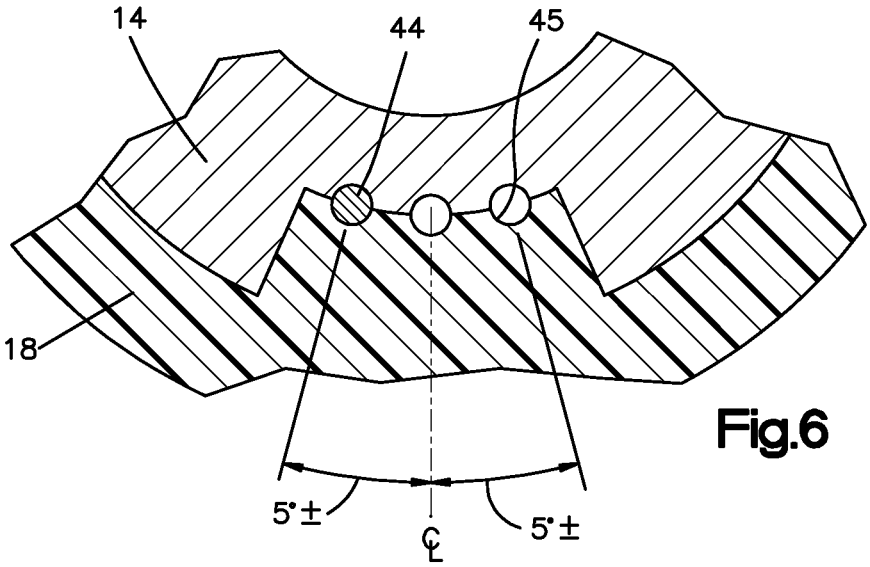
FIG. 6 is a sectional view similar to FIG. 5 depicting an alternate embodiment.

As seen in FIGS. 5 and 6, handle 14 may contain splines or ribs 40 that extend longitudinally along the outer surface of the second end 24 of the handle 14. The splines 40 may also extend radially in the second end 24 of the handle in an alternate embodiment. The splines 40 mesh with channels 42 in the gripping sleeve 18 to serve as guides for slidably receiving the gripping sleeve 18 and prevent torsional slippage or rotation of the gripping sleeve 18 during use.

In still another embodiment, an optional elongated rod 44 which may be a metal wire, rod, or an elastomeric line or rod is positioned fairly centrally in a slot 45 on one of the ridges 46 in the gripping sleeve 18 between the splines 40 to form a reminder rib 48 in the gripping sleeve 18 for a golfer. A reminder rib 48 is a device known and used by some golfers for facilitating their hand placement on the grip 12. The United States Golf Association rules require a reminder rib 48 not to be greater than about 0.04 inches or about 1 millimeter. The diameter of the rod 44 should be equal to or less than the 0.04 inches or 1 millimeter in order to comply with the golf rules. The location of the reminder rib 48 is adjustable by positioning the rod 44 in one of the slots 45 as seen in FIG. 6 in a range of approximately five degrees to approximately fifteen degrees on either side of the center position of the ridge 46. FIG. 6 depicts this feature with the rod positioned on either side of the center position at approximately five degrees, but it should be understood that this range can extend as much as approximately fifteen degrees.

Handle 14 may be constructed from steel, aluminum, titanium or some other metal or metal alloy, fiberglass or graphite, and can be reinforced with carbon or other material fibers if desired.

The gripping sleeve 18 and cap 20 may be made from natural or synthetic rubber, an elastomeric material like a rubber compound, a synthetic plastic, thermoplastic material, silicone material, or mixtures thereof, and may contain fibers or cords imbedded therein for a better gripping. Gripping sleeve 18 may contain on its outer surface indicia for decorative purposes, and/or grooves or notches for gripping purposes.

The gripping sleeve 18 can further comprise one or more layers of a rubber, elastomeric, or thermoplastic material, or combinations of such materials. These layers can be arranged to provide varying durometer values. A durometer value or rating is an international standard for the hardness measurement of rubber, plastic and other non-metallic materials. Durometer values and ratings are described in the American Society for Testing and Material specification ASTM D2240. For example in one embodiment, an inner surface of the sleeve 18 may have a hardness value ranging from approximately twenty-five to approximately fifty Shore A hardness. The outer surface or layer of the sleeve 18 can have a durometer value preferably ranging from approximately twenty-five to approximately ninety Shore A. Any combination of durometer values may be used depending upon the user's desire for a surface grip feel with good frictional qualities and tactile feel coupled with a firmer inner section.

The improved changeable grip 12 of the present disclosure allows the user to select and change grips rapidly based on the optimum weight, feel, look, and moisture absorbency for a given application.

While specific embodiments of the disclosure have been shown and described in detail to illustrate the application of the principles of this disclosure, it will be understood that there may be other embodiments based on this without departing from such principles.

I claim:

1. A golf club shaft with a changeable gripping sleeve, comprising:

an elongated tubular member having an initial diameter, said tubular member having first and second ends, said first end being constructed for attachment to a club head, said second end of said elongated tubular member terminating in a butt end, said butt end having a threaded indentation therein;

said second end of said tubular member having a bell-shaped section integrally formed in said tubular member and spaced from said butt end, said bell-shaped section having a diameter larger in size than said initial diameter, said bell-shaped section having a ledge at an end integrally formed in said elongated tubular member, said ledge of said bell-shaped portion being spaced a distance from said butt end of said elongated tubular member;

a gripping sleeve constructed to slide on to and cover at least a portion of said second end of said tubular member, a lower end of said gripping sleeve abutting against said ledge;

a cap for covering an upper end of said gripping sleeve; and a fastener for securing said cap and thereby said gripping sleeve to said second end of said tubular member, said fastener constructed to mesh with said threaded indentation in said butt end of said tubular member.

2. A golf club shaft with a changeable gripping sleeve according to claim 1, wherein said tubular member is a material being a member selected from the group consisting of steel, titanium, aluminum, a metal or metal alloy, fiberglass and graphite.

3. A golf club shaft with a changeable gripping sleeve according to claim 2, wherein said second end of said tubular member further comprises at least one spline.

4. A golf club shaft with a changeable gripping sleeve according to claim 3, wherein said at least one spline extends longitudinally on said second end of said elongated tubular member towards said butt end.

5. A golf club shaft with a changeable gripping sleeve according to claim 4, wherein said gripping sleeve includes at least one channel constructed to mesh with said at least one spline in said second end of said tubular member.

6. A golf club shaft with a changeable gripping sleeve according to claim 5, wherein said at least one channel comprises a plurality of channels in said gripping sleeve.

7. A golf club shaft with a changeable gripping sleeve according to claim 6, wherein a ridge on one of said channels in said gripping sleeve includes at least one slot for positioning a rod to form a reminder rib for said grip.

8. A golf club shaft with a changeable gripping sleeve according to claim 7, wherein said ridge on one of said channels includes a plurality of slots for positioning said rod from approximately five degrees to approximately fifteen degrees on either said of a center position on said ridge for forming said reminder rib.

9. A golf club shaft with a changeable gripping sleeve according to claim 3, wherein said at least one spline comprises a plurality of splines.

10. A golf club shaft with a changeable gripping sleeve according to claim 3, wherein said at least one spline comprises a plurality of splines extending radially around said second end of said tubular member.

11. A golf club shaft with a changeable gripping sleeve, according to claim 1, wherein said gripping sleeve is a material being a member selected from the group consisting of natural rubber, synthetic rubber, an elastomeric material, a thermoplastic material, a silicone material, and mixtures thereof.

12. A golf club shaft with a changeable gripping sleeve according to claim 1, further comprising a working head attached to said first end of said tubular member.

13. A golf club shaft with a changeable grip gripping sleeve according to claim 1, wherein said fastener is formed integrally with said cap.

* * * * *